United States Patent [19]

Fujiwara et al.

[11] Patent Number: 4,610,852

[45] Date of Patent: Sep. 9, 1986

[54] PROCESS FOR STRIPPING URANIUM

[75] Inventors: Kiyoshi Fujiwara; Shoji Yoshinaga, both of Kudamatsu, Japan

[73] Assignee: Hitachi, Ltd., Tokyo, Japan

[21] Appl. No.: 584,447

[22] Filed: Feb. 28, 1984

Related U.S. Application Data

[63] Continuation-in-part of Ser. No. 448,275, Dec. 9, 1982, abandoned.

[30] Foreign Application Priority Data

Dec. 14, 1981 [JP] Japan ..... 58-200182

[51] Int. Cl.[4] ..... C01G 43/01; B01D 11/04

[52] U.S. Cl. ..... 423/9

[58] Field of Search ..... 423/9

[56] References Cited

PUBLICATIONS

Merritt, Robert C., *The Extractive Metallurgy of Uranium,* Colorado School of Mines Research Institute, 1971, pp. 196–199.

Perry, R. H. and C. H. Chilton, *Chemical Engineers' Handbook,* McGraw-Hill, NY, NY, 1973, p. 21–12.

Bennett et al., *Practical Emulsions,* vol. 1, *Materials and Equipment* Chemical Publishing Co. Inc. NY, 3rd. Ed., 1968, pp. 31–33.

Clayton, W., *The Theory of Emulsions and Their Technical Treatment,* P. Blackiston's Son & Co., Phila. Penna., 2nd Ed, 1928, pp. 202–203.

*Primary Examiner*—Edward A. Miller
*Assistant Examiner*—Matthew A. Thexton
*Attorney, Agent, or Firm*—Antonelli, Terry & Wands

[57] ABSTRACT

Uranium is stably stripped from an organic solvent containing a uranium-laden, amine-based extracting agent into an aqueous ammonium sulfate solution with a very high stripping efficiency in an emulsion-formable high pH range by mixing the organic solvent, the aqueous ammonium sulfate solution and an alkali as a pH-controlling agent, thereby forming a mixture having a pH of 4.5 to 6.0 and a temperature of 15° to 50° C., preferably 25° to 40° C., and subjecting the resulting mixture to an action of centrifugal force of 850 G or higher, thereby separating it into an organic solvent freed from the uranium and an aqueous ammonium sulfate solution containing the uranium.

13 Claims, 6 Drawing Figures

PROCESS FOR STRIPPING URANIUM

BACKGROUND OF THE INVENTION

This application is a continuation-in-part of application Ser. No. 448,275 filed Dec. 9, 1982 now abandoned.

The present invention relates to a process for stripping uranium, and more particularly to a process suitable for stably stripping the uranium with a high stripping efficiency from uranium-laden, amine-based extracting agent contained in an organic solvent into an aqueous ammonium sulfate solution.

DESCRIPTION OF THE PRIOR ART

Generally, a process for extracting uranium comprises an extracting step for extracting uranium in an aqueous solution by an amine-based, extracting agent contained in an organic solvent, a washing step of washing the organic solvent containing the uranium-laden, amine-based extracting agent, and a stripping step of stripping the uranium laden in the amine-based extracting agent contained in the organic solvent into a stripping solution, where in the stripping step a counter-current contacting method with 3 to 5 stages of mixer-settler type extractors as a uranium stripping apparatus using an aqueous ammonium sulfate solution as the stripping solution has been so far employed.

The counter-current contacting method so far employed to strip the uranium will be described below, referring to FIG. 1.

In FIG. 1, mixer-settler type extractors are arranged at four stages in series through lines 12*a*–12*e* for passing an organic solvent containing uranium-laden, amine-based extracting agent (which will be hereinafter referred to as "solvent") and through lines 13*a*–13*e* for passing an aqueous ammonium sulfate solution as a stripping solution in a reversed direction to the flow direction of the solvent (which will be hereinafter referred to as "aqueous ammonium sulfate solution"), the mixer-settler type extractors being comprised of mixers 10*a*–10*d* for mixing the solvent, the aqueous ammonium sulfate solution, and an alkali as a pH-controlling agent to obtain a mixture, and settlers 11*a*–11*d* for separating the mixture by settling. The mixers 10*a*–10*d* are provided with lines 14*a*–14*d* for supplying the alkali to the mixers.

The mixer-settler type extractors are referred to as a first stage extractor, a second stage extractor, a third stage extractor and a last stage extractor according to the flow direction of the solvent.

The solvent is supplied to the first stage extractor 10*a* through the line 12*a*, and the aqueous ammonium sulfate solution thereto through the line 13*b*, and also an appropriate amount of the alkali, for example, aqua ammonia, ammonia gas, etc. is supplied thereto through the line 14*a*. The solvent, the aqueous ammonium sulfate solution, and the alkali thus supplied to the mixer 10*a* are mixed in the mixer 10*a* to obtain a mixture. Then, the mixture is led to a settler 11*a* and settled. The settled mixture is separated into the aqueous ammonium sulfate solution and the solvent. The separated aqueous ammonium sulfate solution is discharged to the outside of the system through the line 13*a*, whereas the separated solvent is supplied to the mixer 10*b* of the second stage extractor through the line 12*b*.

Into the mixer 10*b* are supplied the aqueous ammonium sulfate solution through the line 13*c* from the settler 11*c* of the third stage extractor and an appropriate amount of the alkali through the line 14*b*. The solvent, the aqueous ammonium sulfate solution and the alkali thus supplied to the mixer 10*b* are mixed in the mixer 10*b* by agitation to form a mixture. Then, the resulting mixture is led to a settler 11*b* of the second stage extractor and settled and the mixture is separated into the aqueous ammonium sulfate solution and the solvent by settling. The separated aqueous ammonium sulfate solution is supplied to the mixer 10*a* of the first stage extractor through the line 13*b*, whereas the separated solvent is supplied to the mixer 10*c* of third stage extractor through the line 12*c*. The foregoing operations are successively repeated in the third stage extractor and the final stage extractor, and the uranium in the solvent is stripped into the aqueous ammonium sulfate solution, stage after stage. Thus, the uranium concentration of the solvent becomes lower from the first stage extractor to the second stage extractor, and so on, and the uranium concentration of the solvent leaving the final stage extractor to the outside of the system through the line 12*e* is substantially zero. On the other hand, the uranium concentration of the aqueous ammonium sulfate solution becomes higher from the last stage extractor to the third stage extractor.

In such a uranium stripping method, the mixture formed in the mixers is settled in the settlers to separate the mixture into the aqueous ammonium sulfate solution and the solvent, and thus their separation efficiency is a problem. That is, when the pH of the mixture formed in the mixer is above 4.0, mixture is liable to undergo emulsification, resulting in unstable separation of the aqueous ammonium sulfate solution from the solvent.

Furthermore, when the pH of the mixture exceeds about 4.5, an emulsion is formed, and the separation of the aqueous ammonium sulfate solution from the solvent is no more possible, that is, the stripping of uranium is impossible. On the other hand, the stripping efficiency of uranium is increased with increasing pH.

The foregoing fact is known (Robert C. Merritt: The Extractive Metallurgy of Uranium, Colorado School of Mines Research Institute, 1971, pp. 196–199). That is, it is disclosed in the said literature that, when uranium stripping is carried out in a mixer-settler type extractor using an aqueous ammonium sulfate solution as a stripping solution, the uranium stripping efficiency is increased with an increase in the pH of the mixture from 3.5 to 4.3 and a problem of selecting an optimum pH of the mixture is restricted because uranium starts to precipitate when the pH of the mixture becames neutral. Furthermore, it is disclosed that, when the pH of the mixture is in a range of 4.3 to neutral, the phase separation is deteriorated, resulting in formation of a very troublesome emulsion, and, as a result, it is impossible to conduct uranium stripping when the pH of the mixture exceeds 4.3.

In the countercurrent contact method with 3 to 5 stages of mixer-settler type extractors in series as uranium-stripping apparatuses using an aqueous ammonium sulfate solution as a stripping solution, a pH of 3.5 to 4.5 is generally selected for the mixture in view of a relationship between the separating efficiency between the aqueous ammonium sulfate solution and the solvent and the uranium stripping efficiency. However, the pH range of the mixture is very close to the pH of the mixture at which the separation of the aqueous ammonium sulfate solution from the solvent is unstable or impossible, and thus it is difficult to strip uranium stably from the solvent into the aqueous ammonium sulfate solution, resulting in frequent failure to separate the aqueous ammonium sulfate solution from the solvent and consequent discontinued operation of the mixer-settler type extractors.

The uranium stripping efficiency at a pH of 3.5 to 4.5 for the mixture has a limit, i.e. about 98.8% at pH 4.3, and no higher uranium stripping efficiency is obtained above a higher pH.

SUMMARY OF THE INVENTION

An object of the present invention is to provide a process for stripping uranium from a uranium-laden solvent into an aqueous ammonium sulfate solution stably with a very high stripping efficiency.

According to the present invention, a process for stripping uranium is provided, which comprises mixing a solvent containing a uranium-laden, amine-based extracting agent, an aqueous ammonium sulfate solution as a stripping solution and a pH-controlling agent, to obtain a mixture having a pH of 4.5 to 6.0, and a temperature of 15° to 50° C., preferably 25° to 40° C., and subjecting the mixture to centrifuge, thereby separating the mixture into the solvent and the aqueous ammonium sulfate solution under a centrifugal force of at least 850G, where uranium in the solvent is stripped into the aqueous ammonium sulfate solution even in a broad pH range, which is liable to form an emulsion, stably with a very high stripping efficiency.

DESCRIPTION OF THE PREFERRED EMBODIMENTS

In the stripping of uranium from the solvent into the aqueous ammonium sulfate solution, the distribution coefficient of uranium between the solvent and the aqueous ammonium sulfate solution is a problem. Suppose the uranium concentration of the solvent is $[U]_s$ and the uranium concentration of the aqueous ammonium sulfate solution is $[U]_w$, the distribution coefficient $\alpha$ can be represented by the following equation:

$$\alpha=[U]_w/[U]_s$$

The distribution coefficient $\alpha$ approximates 2–5 at a pH of 3.8–4.3, though dependent upon the concentrations of amine-based extracting agent and uranium in the solvent, and increases with increasing pH.

The present inventors have made extensive studies and have found the following facts: (1) In the uranium stripping operation, the concentration of uranium remaining in the solvent depends upon the pH of the mixture, and it decreases with increasing pH. That is, above pH 4.5, the distribution coefficient is drastically increased. That is, substantially all uranium is stripped from the solvent into the aqueous ammonium sulfate solution.

(2) At a pH of 4.5–4.7, an emulsion is liable to be formed, and above pH 4.7, the formation of emulsion is remarkable, and separation of the solvent from the aqueous ammonium sulfate solution is difficult by gravity settling. (3) At a higher pH, uranium precipitates even when the aqueous ammonium sulfate solution has a low uranium concentration.

The present invention is based on these findings.

The present invention will be described in detail below, referring to FIG. 2.

Figure 1:
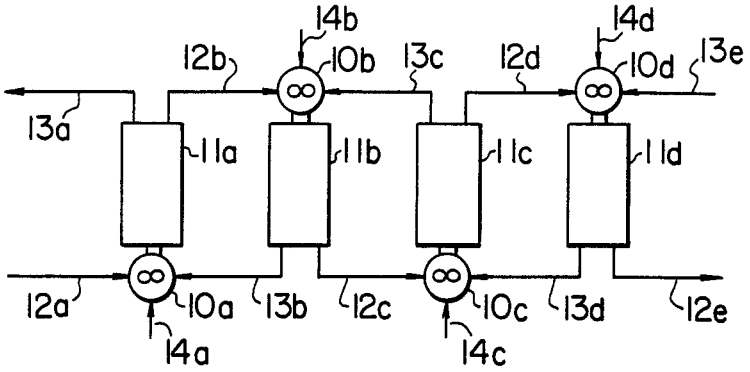
FIG. 1 PRIOR ART
FIG. 1 is a flow diagram showing a system for stripping uranium according to the prior art.
Figure 2:
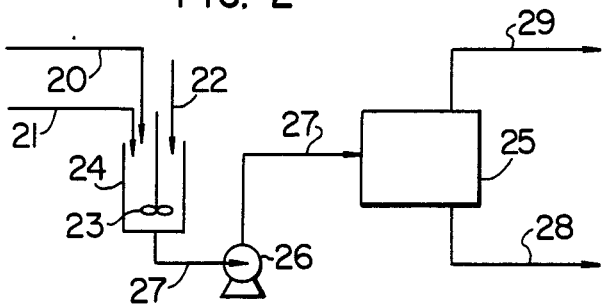
FIG. 2 is a flow diagram showing one embodiment of a system for stripping uranium according to the present invention.

In FIG. 2, a mixer 24 provided with a rotatable agitator 23, for example, a mixer with a turbine agitator with 6 blades, is connected by a line 20 for supplying a solvent containing a uranium-laden, amine-based extracting agent, a line 21 for supplying an aqueous ammonium sulfate solution, and a line 22 for supplying an alkali as a pH-controlling agent, and also the mixer 24 is connected by a centrifuge 25, for example, DeLaval type centrifuge, through a line 27 and a pump 26 provided in the line 27. The centrifuge 25 is connected by a line 28 for discharging the separated aqueous ammonium sulfate solution to the outside of the system, and also by a line 29 for discharging the separated solvent to the outside of the system.

A solvent containing the uranium-laden, amine-based extracting agent and an aqueous ammonium sulfate solution are continuously supplied to the mixer 24 through the line 20 and the line 21, respectively, where a ratio of the feed rate of the solvent containing the uranium-laden, amine-based extracting agent to that of the aqueous ammonium sulfate solution into the mixer 24 depends upon a ratio of the uranium concentration of the solvent to the uranium concentration of the aqueous ammonium sulfate solution after the stripping. The uranium concentration of the aqueous ammonium sulfate solution after the stripping is preset before the stripping operation. At the same time, an alkali is added to the mixer 24 through the line 22. The solvent containing the uranium-laden, amine-based extracting agent, the aqueous ammonium sulfate solution and the alkali are agitated by agitator 23 in the mixer 24 and mixed with an agitating power of not more than 1.5 HP/m$^3$ for an agitating time of at least 5 min., preferably 5 to 40 min., whereby a mixture whose pH has been adjusted to 4.5–6.0 is obtained. At that time, the temperature of the mixture is adjusted to 15°–50°, preferably 25°–40° C. Below 15° C., the mixture is liable to undergo poor phase separation in the centrifuge 25, whereas above 50° C., the solvent evaporates, resulting in economical inconvenience. The mixture is fed to the centrifuge 25 through a line 27 by a pump 26 at the same rate as that to the mixer 24, and subjected to a centrifugal force of 850 G or higher to separate the mixture into the solvent and the aqueous ammonium sulfate solution, whereby uranium is stripped from the solvent into the aqueous ammonium sulfate solution. No sufficient separation of the solvent from the aqueous ammonium sulfate solution is obtained with a centrifugal force of less than 850 G.

Uranium stripping test with a solvent containing 3 g/l of uranium in terms of $U_3O_8$ at the pH of 5.0 in the mixer 24 reveals that the aqueous ammonium solution and the solvent, as discharged to the outside of the system through the lines 29 and 28, respectively, from the centrifuge 25 have 4.5 g/l of uranium and 0.001–0.006 g/l of uranium in the term of $U_3O_8$, respectively. That is, a very high stripping efficiency of 99.9% can be obtained.

Likewise, when the pH of the mixture is adjusted to 4.5 and 6.0 and the uranium stripping test is conducted, a very high uranium stripping efficiency, for example, 99.5% at pH 4.5 and 99.98% at pH 6.0, is obtained.

Uranium concentration of the solvent is restricted, because the amine as an extracting agent is bonded to the uranium in the solvent, and the resulting compound of amine and uranium has a limited solubility in the solvent, usually, kerosene. Generally, the uranium concentration of the solvent is about 5 g/l or less.

In the process for stripping uranium according to the present invention, as shown in the foregoing embodiment, good separation into the solvent and the aqueous ammonium sulfate solution can be obtained by centrifuge even in the emulsion-forming pH range. In other words, the uranium stripping can be attained stably with a very high stripping efficiency.

Another embodiment of the present invention will be described below, referring to FIG. 3, where the same members as in FIG. 2 are identified with the same reference numerals, whose further explanation is omitted.

Figure 3:
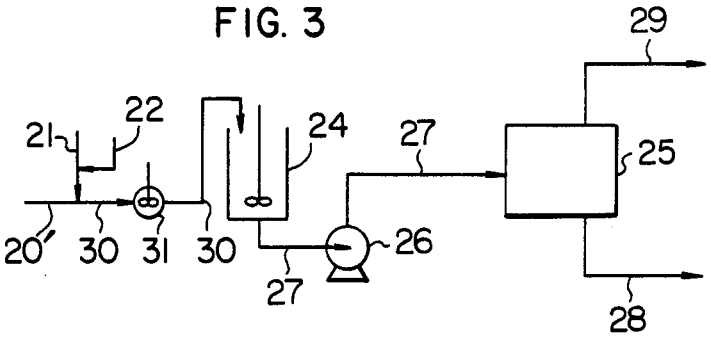
FIG. 3 is a flow diagram showing another embodiment of the present invention.

In FIG. 3, a line 21' for supplying an aqueous ammonium sulfate solution joined with a line 20' for supplying the solvent containing a uranium-laden, amine-based extracting agent and a line 22' for supplying an alkali is further joined to a line 30, which is connected to a mixer 24 through another mixer 31, for example, a line mixer.

An alkali from the line 22' is joined with an aqueous ammonium sulfate solution passing through the line 21'. The mixture of the alkali and the aqueous ammonium sulfate solution is further joined with the solvent passing through the line 20', and the resulting mixture is supplied to the another mixer 31 through the line 30.

The feed rates of the solvent and the aqueous ammonium sulfate solution into the another mixer 31 are determined in the same manner as in the first embodiment. In the another mixer 31, the solvent, the aqueous ammonium sulfate solution and the alkali are mixed with an agitating power of 2.5 HP/m$^3$ or higher for an agitating time of not more than 5 minutes to make a mixture. With an agitating power of less than 2.5 HP/m$^3$ for more than 5 minute, the generated emulsion turns an emulsion that is no more separable even under a centrifugal force. The temperature of the mixture is adjusted to 15°–50°, preferably 25°–40° C. The mixture is fed to the mixer 24 from the another mixer 31 through a line 30 and gently mixed with an agitating power of not more than 1.5 HP/m$^3$ for an agitating time of at least 5 minutes, preferably 5–40 minutes. With an agitating power of 1.5 HP/m$^3$ or higher for less than 5 minutes, the uranium stripping efficiency is lowered. The temperature of the mixture is adjusted to 15°–50° C., preferably 25°–40° C., and then it is fed to the centrifuge 25 through a line 27 by a pump 26 and subjected to a centrifugal force of 850 G or higher to separate the mixture into the solvent and the aqueous ammonium sulfate solution, where the uranium is stripped from the solvent into the aqueous ammonium sulfate solution. The separated solvent and aqueous ammonium sulfate solution are discharged to the outside of the system through lines 29 and 28, respectively.

In the stripping process according to the present invention as shown in the foregoing embodiment, the solvent, the aqueous ammonium sulfate solution, and the alkali are mixed together within a short time by high speed agitation, and then by more gentle agitation. This procedure can prevent local increase in pH and precipitation of uranium in the mixer and the uranium stripping can be more stably carried out.

Further embodiment of the present invention will be described below, referring to FIG. 4, where the same members as in FIG. 2 are identified with the same reference numerals, and further explanation of these members is omitted.

Figure 4:
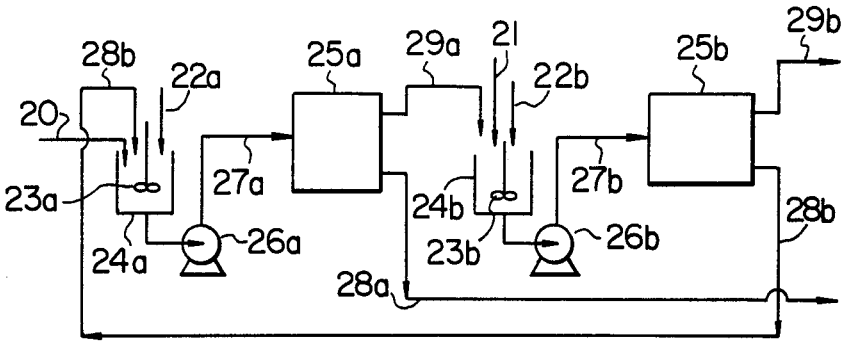
FIG. 4 is a flow diagram showing further embodiment of the present invention.

In FIG. 4, two units of the apparatus for stripping uranium as described referring to FIG. 2 are provided at two stages in series. The units of the apparatus are referred to as the first stage apparatus and the last stage apparatus in accordance with the flow direction of the solvent. A mixer **24*b* in the last stage apparatus with a line 21 for supplying an aqueous ammonium sulfate solution and a line 22*b* for supplying an alkali as connected to the mixer 24*b*, is provided with a line 29*a* for discharging a solvent from a centrifuge 25*a* in the first stage apparatus. A mixer 24*a* in the first stage apparatus with a line 20 for supplying a solvent and a line 22*a* for supplying an alkali as connected to the mixer 24*a*, is provided with a line 28*b* for discharging an aqueous ammonium sulfate solution from a centrifuge 25*b*** in the last stage apparatus.

A solvent containing uranium-laden, amine-based extracting agent through the line 20 and the aqueous ammonium sulfate solution separated by the centrifuge **25*b* in the last stage apparatus through the line 28*b* are supplied to the mixer 24*a* of the first stage apparatus, while supplying an alkali to the mixer 24*a* of the first stage apparatus through a line 22*a* and the solvent, the aqueous ammonium sulfate solution and the alkali are mixed in the mixer 24*a* of the first stage apparatus by an agitator 23*a* to obtain a mixture. The resulting mixture is then supplied to the centrifuge 25*a* of the first stage apparatus from the mixer 24*a* of the first stage apparatus through a line 27*a* by a pump 26*a*, and separated into the solvent and the aqueous ammonium sulfate solution by centrifuge, whereby a portion of uranium is stripped from the solvent into the aqueous ammonium sulfate solution preparatorily. The aqueous ammonium sulfate solution separated by the centrifuge 25*a* of the first stage apparatus is discharged to the outside of the system through a line 28*a*, whereas the separated solvent is supplied to the mixer 24*b* of the last stage apparatus through the line 29*a*. A fresh aqueous ammonium sulfate solution is supplied to the mixer 24*b* of the last stage apparatus through a line 21, while supplying an alkali to the mixer 24*b* through a line 22*b*. The solvent, the aqueous ammonium sulfate solution and the alkali are mixed together in the mixer 24*b* of the last stage apparatus by an agitator 23*b* to obtain a mixture. The resulting mixture is then supplied from the mixer 24*b* of the last stage apparatus to the centrifuge 25*b* of the last stage apparatus through a line 27*b* by a pump 26*b* and separated by the centrifugal force into the solvent and the aqueous ammonium sulfate solution, whereby uranium remaining in the solvent is stripped into the aqueous ammonium sulfate solution. The solvent separated by the centrifuge 25*b* is discharged to the outside of the system through a line 29*b*, whereas the aqueous ammonium sulfate solution separated by the centrifuge 25*b* of the last stage apparatus is supplied to the mixer 24*a* of the first stage apparatus through the line 28*b*. In that case, the pH in the mixer 24*b* of the last stage apparatus is adjusted to 4.5–6.0, whereas the pH in the mixer 24***a* of the first stage apparatus is adjusted according to FIG. 5.

Figure 5:
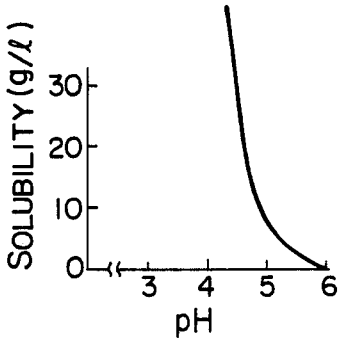
FIG. 5 is a diagram showing relation between the pH and the solubility of uranium in an aqueous ammonium sulfate solution.

FIG. 5 is a diagram showing relations between the pH and the solubility of uranium in an aqueous ammonium sulfate solution, which will be hereinafter referred to merely as "solubility", where the solubility is about 25 g/l at pH 4.5, about 6 g/l at pH 5, and less than 1 g/l at pH 6. That is, the pH in the mixer 24*b* of the last stage apparatus is adjusted to 4.5–6.0, and thus the aqueous ammonium sulfate solution separated by the centrifuge 25*b* of the last stage apparatus and supplied to the mixer 24*a* of the first stage apparatus can dissolve only a few grams/l of uranium. However, when the pH in the mixer 24*a* of the first stage apparatus is adjusted in accordance with the uranium concentration of the solvent so as to increase the solubility, the uranium is much less precipitatable in the mixer 24*a* of the first stage apparatus and consequently the aqueous ammonium sulfate solution separated by the centrifuge 25*a* of the first stage apparatus and discharged to the outside of the system through the line 28*a* has a higher uranium concentration.

Other conditions for the last stage apparatus for stripping uranium are the same as in the said first embodiment.

Tests of stripping uranium from a solvent having a uranium concentration of 3.5 g/l into an aqueous ammonium sulfate solution, whose liquid volume is 1/7.9 times that of the solvent, with the pH of a mixture in the first stage apparatus for stripping uranium being set to 4.3 and that of a mixture in the last stage apparatus for stripping uranium being set to 5.0, reveal that an aqueous ammonium sulfate solution having a uranium concentration of 27.6 g/l can be obtained without any precipitation and with the uranium stripping efficiency of 99.6%.

In the process for stripping uranium according to the present invention, as shown in the foregoing embodiment, the pH in the first stage apparatus for stripping uranium is adjusted to such a degree as not to precipitate uranium, and the pH in the last stage apparatus for stripping uranium is adjusted to 4.5–6.0 to make the uranium concentration of the aqueous ammonium sulfate solution higher with a very high stripping efficiency.

Generally, the uranium purification process includes a uranium separation by precipitation as a successive step to the uranium stripping step. To reduce the treating liquid volume in the successive step, it is keenly required to make a uranium concentration of the aqueous ammonium sulfate solution higher than 10 g/l. The present process for stripping uranium according to the foregoing embodiment can very effectively meet the requirement.

Furthermore, transfer of uranium in the first stage apparatus for stripping uranium is a function of distribution coefficient, and thus the uranium concentration of the aqueous ammonium sulfate solution separated by the centrifuge of the first stage apparatus can be preset by the distribution coefficient. The number of preceding stage apparatus units before the last stage apparatus is not particularly limited to that shown in the preceding embodiment.

When the pH in the first stage mixer is adjusted to an emulsion formation controllable state in the last embodiment, separation into the solvent and the aqueous ammonium sulfate solution, i.e. preparatory stripping of uranium, can be thoroughly carried out by settling under gravity without applying a centrifugal force thereto, and the same effect as described above can be obtained.

Figure 6:
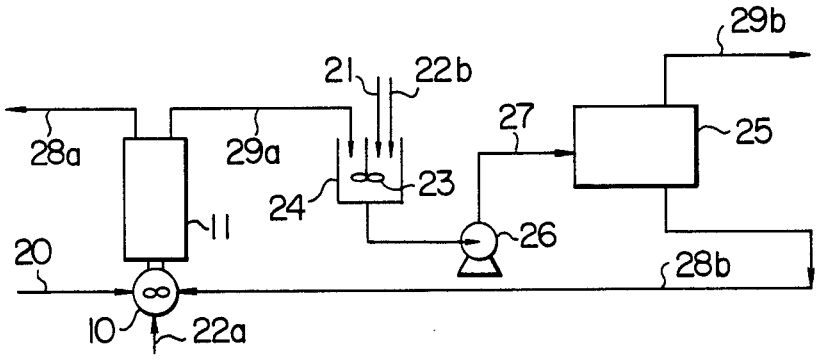
FIG. 6 is a flow diagram showing a fourth embodiment of a system for stripping uranium according to the present invention.

FIG. 6 illustrates such an embodiment as above. To a mixer 10 of mixer-setter type extractor as the first stage apparatus for stripping uranium is connected a line 20 for supplying a solvent containing uranium-laden, amine-based extracting agent and a line 22*a* for supplying an alkali. Likewise, a line 28*a* for discharging a separated aqueous ammonium sulfate solution to the outside of the system is connected to a settler 11. The settler 11 is communicated with a mixer 24 of last stage apparatus for stripping uranium through a line 29*a* for supplying the separated solvent, and further a line 21 for supplying an aqueous ammonium sulfate solution and a line 22*b* for supplying an alkali are connected to the mixer 24. The mixer 24 of the last stage apparatus is communicated with a centrifuge 25 of the last stage apparatus through a line 27 provided with a pump 26. Furthermore, a line 28*b* for discharging the separated ammonium sulfate solution and a line 29*b* for discharging the separated solvent to the outside of the system are connected to the centrifuge 25. The line 28*b* is connected to the mixer 10 of the mixer-settler type extractor as the first stage apparatus for stripping uranium.

A solvent containing uranium-laden, amine-based extracting agent is supplied to the mixer 10 of the first stage apparatus through the line 20, and the aqueous ammonium sulfate solution separated in the centrifuge 25 of the last stage apparatus is supplied to the mixer 10 of the first stage apparatus through the line 28*b*, while an alkali is supplied to the mixer 10 of the first stage apparatus through the line 22*a*. The solvent, the aqueous ammonium sulfate solution and the alkali are mixed in the mixer 10 of the first stage apparatus to obtain a mixture. The resulting mixture is then led to the settler 11 of the first stage apparatus and settled. The mixture is separated into the aqueous ammonium sulfate solution and the solvent by settling, whereby a portion of the uranium in the solvent is stripped into the aqueous ammonium sulfate solution preparatorily. The aqueous ammonium sulfate solution separated in the settler 11 of the first stage apparatus is discharged to the outside of the system through the line 28*a*, whereas the separated solvent is supplied to the mixer 24 of the last stage apparatus through the line 29*a*. An aqueous ammonium sulfate solution is also supplied to the mixer 24 of the last stage apparatus through the line 21, and an alkali is also supplied to the mixer 24 through the line 22*b*. In the mixer 24 of the last stage apparatus, the solvent, the aqueous ammonium sulfate solution and the alkali are mixed by the agitator 23 to obtain a mixture. Then, the resulting mixture is supplied to the centrifuge 25 of the last stage apparatus through the line 27 by the pump 26 from the mixer 24 of the last stage apparatus and subjected to a centrifugal force, whereby the mixture is separated into the solvent and the aqueous ammonium sulfate solution, and the uranium remaining in the solvent is stripped into the aqueous ammonium sulfate solution.

The aqueous ammonium sulfate solution separated in the centrifuge 25 of the last stage apparatus is supplied to the mixer 10 of the first stage apparatus through the line 28*b*, whereas the separated solvent is discharged to the outisde of the system through the line 29*b*. Conditions for stripping uranium in the last stage apparatus are the same as in the said first embodiment. The number of preceding stages of mixer-settler type extractors before the last stage apparatus for stripping uranium is not particularly limited to that shown in the preceding embodiment.

According to the present invention, as described above, a solvent containing uranium-laden, amine-based extracting agent, an aqueous ammonium sulfate solution and an alkali are mixed together, thereby forming a mixture having a pH of 4.5 to 6.0 and a temperature of 15° to 50° C., preferably 25° to 40° C., and the resulting mixture is subjected to an action of centrifugal force of 850 G or higher in a centrifuge to separate it into the solvent and the aqueous ammonium sulfate solution, where separation into the solvent and the aqueous ammonium sulfate solution can be effectively attained even in the emulsion-forming pH range, and thus uranium can- be stably stripped from the solvent into the aqueous ammonium sulfate solution with a very high stripping efficiency.

What is claimed is:

1. A process for stripping uranium from an organic solvent containing a uranium-laden, amine-based extracting agent into an aqueous ammonium sulfate solution, which comprises mixing an organic solvent containing a uranium-laden, amine-based extracting agent, an aqueous ammonium sulfate solution and an alkali, to obtain a mixture having a pH of 4.5 to 6.0 and a temperature of 15° to 50° C., and subjecting the resulting mixture to an action of centrifugal force of 850 G or higher, thereby separting the mixture into an organic solvent freed from the uranium and an aqueous ammonium sulfate solution containing the uraniun,

2. A process according to claim 1, wherein the organic solvent containing uranium-laden, amine-based extracting agent, the aqueous ammonium sulfate solution and the alkali are mixed with an agitating power of 2.5 $HP/m^3$ or higher for an agitating time of not more than 5 minutes and then the resulting mixture is successively mixed with an agitating power of not more than 1.5 $HP/m^3$ for an agitating time of 5 minutes or more.

3. A process according to claim 2, wherein said resulting mixture is successively mixed for an agitating time of 5–40 minutes.

4. A process according to claim 1, wherein the temperature of the mixture is 25° to 40° C.

5. A process for stripping uranium from an organic solvent containing a uranium-laden amine-based extracting agent into an aqueous ammonium sulfate solution, which comprises stripping a portion of uranium from an organic solvent containing a uranium-laden, amine-based extracting agent into an aqueous ammonium sulfate solution preparatorily, mixing the organic solvent preparatorily stripped of the portion of uranium, an aqueous ammonium sulfate solution, and an alkali, to form a mixture having a pH of at least 4.5, at which a distribution coefficient suddenly increases and substantially all of the uranium is stripped from the organic solvent into the aqueous ammonium sulfate solution, and up to having a pH of 4.5 to 6.0 and a temperature of 15° to 50° C., and subjecting the resulting mixture to an action of centrifugal force of 850 G or higher, thereby separating the mixture into an organic solvent freed from the uranium and an aqueous ammonium sulfate solution containing the uranium.

6. A process according to claim 5, wherein the aqueous ammonium sulfate solution containing the uranium separated from the organic solvent freed from the uranium by subjecting the mixture of the organic solvent containing a uranium-laden, amine-based extracting agent, the aqueous ammonium sulfate solution and the alkali to the action of centrifugal force is used as the aqueous ammonium sulfate solution for stripping the portion of uranium from the organic solvent preparatorily.

7. A process according to claim 5, wherein the mixture of the organic solvent containing a uranium-laden, amine-based extracting agent, the aqueous ammonium sulfate solution, and the alkali formed during said stripping is settled, thereby separating the mixture into a solvent freed from the uranium and an aqueous ammonium sulfate solution containing the uranium, and the separated aqueous ammonium sulfate solution is discharged.

8. A process according to claim 7, including a plurality of stages, with the portion of uranium being stripped from the organic solvent into the aqueous ammonium sulfate solution preparatorily in the first stage, and the mixture being separated into an organic solvent freed from the uranium and an aqueous ammonium sulfate solution containing the uranium in the last stage, with respect to the flow direction of the organic solvent.

9. A process according to claim 7, wherein the pH during the stripping of a portion of uranium into an aqueous ammonium sulfate solution is adjusted such that uranium does not precipitate during said stripping.

10. A process according to claim 3, wherein the temperature of the mixture is 25°–40° C.

11. A process according to claim 5, including a plurality of stages, with the portion of uranium being stripped from the organic solvent into the aqueous ammonium sulfate solution preparatorily in the first stage, and the mixture being separated into an organic solvent freed from the uranium and an aqueous ammonium sulfate solution containing the uranium in the last stage, with respect to the flow direction of the organic solvent.

12. A process according to claim 5, wherein the organic solvent separated from said mixture by the action of centrifugal force is discharged.

13. A process according to claim 5, wherein said aqueous ammonium sulfate solution containing the uranium, separated from said mixture by the action of centrifugal force, is used as the aqueous ammonium sulfate solution for stripping the portion of the uranium from the organic solvent preparatorily.

* * * * *